US005667149A

United States Patent [19]

Eisinger

[11] Patent Number: 5,667,149

[45] Date of Patent: Sep. 16, 1997

[54] SOLIDS PULVERIZER MILL AND PROCESS UTILIZING INTERACTIVE AIR PORT NOZZLES

[75] Inventor: Frantisek L. Eisinger, Demarest, N.J.

[73] Assignee: Foster Wheeler Energy Corporation, Clinton, N.J.

[21] Appl. No.: 497,847

[22] Filed: Jul. 3, 1995

[51] Int. Cl.[6] ..... B02C 15/00

[52] U.S. Cl. ..... 241/18; 241/19; 241/119; 241/121

[58] Field of Search ..... 241/18, 24, 119, 241/121, 19

[56] References Cited

U.S. PATENT DOCUMENTS

| | | | |
|---|---|---|---|
| 4,927,086 | 5/1990 | Henne et al. | 241/80 |
| 5,020,734 | 6/1991 | Novotny et al. | 241/119 |
| 5,048,761 | 9/1991 | Kim | 241/19 |
| 5,186,404 | 2/1993 | Wark | 241/119 |
| 5,330,110 | 7/1994 | Williams | 241/53 |

*Primary Examiner*—John M. Husar
*Attorney, Agent, or Firm*—Martin Smolowitz

[57] ABSTRACT

A solids pulverizing mill for producing fine particles such as coal dust, which includes a housing having a centrally located coal feed chute and enclosing an annular-shaped air port ring containing multiple nozzles located around a rotatable grinding table. Multiple grinding rollers press down and rotate upon the coal on the rotatable grinding table so as to pulverize the coal, which is then entrained by multiple intersecting and strongly interacting air jet streams upwardly from the grinding table through a classifier section to an exit conduit. The air port nozzle ring is fitted with multiple angled flow passages from which adjacent air jet streams intersect and interact strongly with the adjacent streams to product intense turbulence, which prevents undesirable acoustic vibration of the upflowing air/coal material within the mill housing. The centerlines of adjacent air jet nozzles intersect at an included angle of at least 20° and not exceeding 90°, each nozzle has cross-sectional area of 10–50 in.$^2$, and provides nozzle exit air flow velocities of 140–250 ft/sec so as to prevent undesired acoustic resonance vibrations within the pulverizer mill.

17 Claims, 7 Drawing Sheets

28
49
46
46
C
C
10
47
B
B
47
12a
A
A
48
48
12
30
31
45
34
36
33
38
37
44
3
3
39
23
22
21
12b
40
19
42
14
20
16
16
24
18
18

FIG. 6A
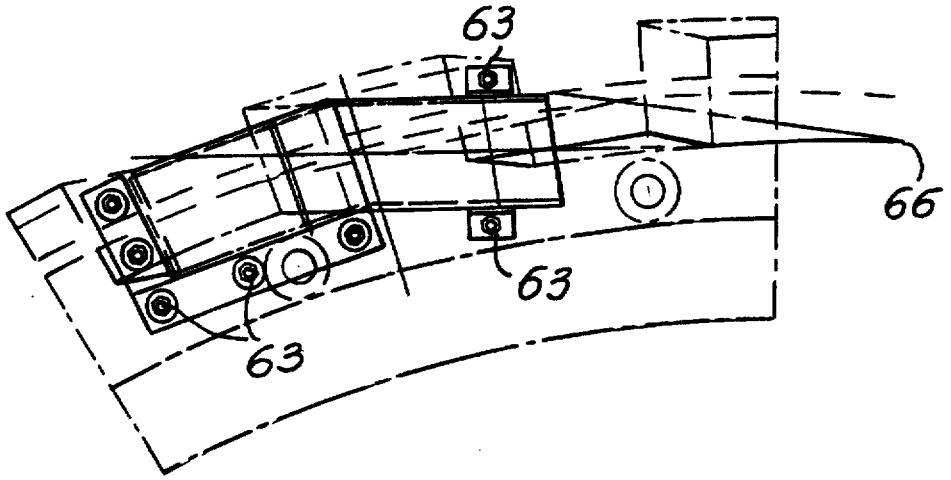
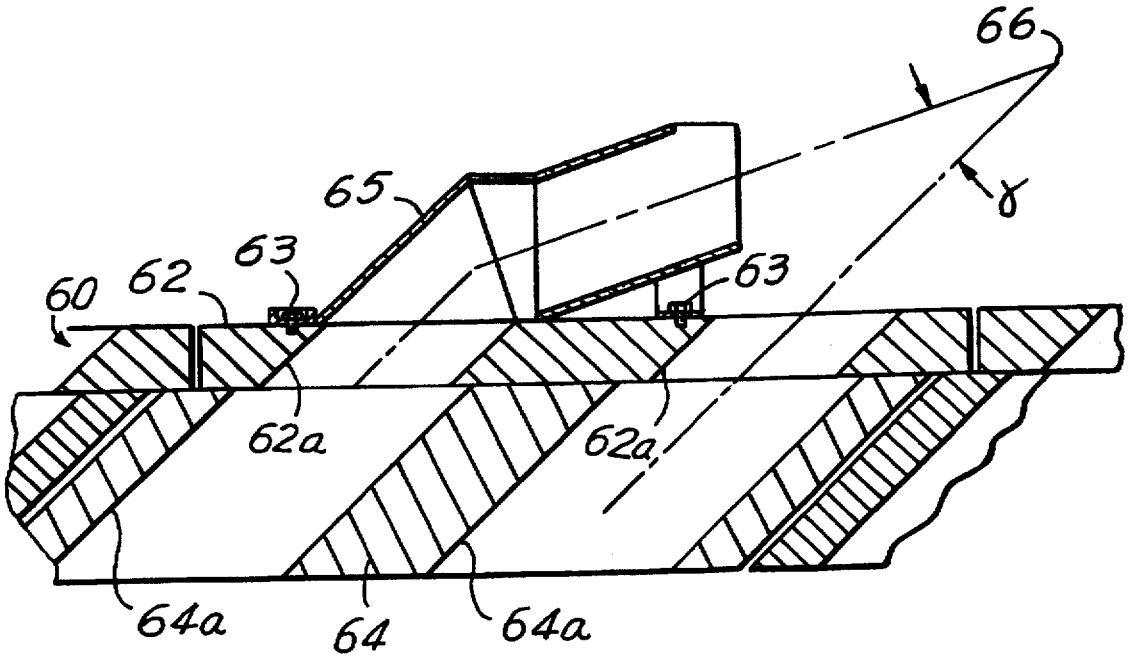
FIG. 6B

SOLIDS PULVERIZER MILL AND PROCESS UTILIZING INTERACTIVE AIR PORT NOZZLES

BACKGROUND OF INVENTION

This invention pertains to solids pulverizer mills having multiple air port nozzles oriented for flow stream interaction and control of acoustic resonance vibrations in the mill. It pertains particularly to a coal pulverizing mill and process providing multiple intersecting and interactive air jet streams for effectively entraining the pulverized coal upwardly without causing acoustic resonance vibrations in the mill.

Pulverizer mills such as used for grinding raw coal to small particle size for feed to combustion furnaces are well known. For example, U.S. Pat. No. 3,465,971 to Dalenberg et al discloses a coal pulverizing mill with stationary deflector vanes positioned above the grinding ring for directing airborne pulverized material downwardly and inwardly back towards the grinding ring. U.S. Pat. No. 4,234,132 to Maliszewski discloses a pulverizing mill having stationary air deflector means located above the rotary grinding table. U.S. Pat. No. 4,602,745 to Maliszewski et al discloses a bowl pulverizer mill having primary classifier containing vanes located above the grinding table and consisting of converging/diverging orifice means. U.S. Pat. No. 4,602,745 to Provost discloses a pulverizer mill having a circumferential throat ring containing a plurality of angularly disposed stationary air channels through which air is forced upwardly in contact with the pulverized coal causing it to be entrained upwardly. U.S. Pat. No. 5,020,734 to Novotny et al discloses a pulverizer having a rotary table with multiple angled replaceable air ports. Also, U.S. Pat. No. 5,090,631 to Wark discloses a pulverizer mill having adjustable deflector air flow rate control means provided around the rotatable table. However, none of the known prior art is directed to use of multiple air ports providing angled intersecting air jet streams which are sufficiently interacting to produce intense turbulence, and may be adjustable so as to reduce or eliminate acoustic resonant vibrations of the entrained air-coal mixture mass in a pulverizer mill.

Coal pulverizer mills grind coal typically from 0.5 to 2 inch size pieces to provide fine coal dust particles usually less than a micron up to several microns in size. The grinding is accomplished by multiple grinding or pulverizing rollers rotating about their own axes and crushing the coal against a rotating table driven by a motor through a speed reducer. The rotation of the table induces rotation of the rollers which are pressed downwardly either by springs or by hydraulic or pneumatic means toward the rotary table to enhance the coal crushing and pulverizing action. The raw coal feed enters the mill vertically by gravity and the ground pulverized coal is carried from the mill by air entrainment upwardly through a classifier section to external burners for combustion. The mill classifier allows the fine enough particles to pass on to the external burners, while the coarser size particles are returned to the mill rotary table for further grinding and size reduction.

A substantial air flow rate is needed to carry the pulverized coal from the mill table upwardly through the classifier and to the burners. The air/coal weight ratio needed for pulverization, coal particle transport and combustion is in the range of 1.5/1 to 3.5/1, depending on coal type and flow rate. The air enters the mill plenum located beneath the grinding table, and enters the grinding section through multiple air ports which are typically evenly spaced around the grinding table circumference. Many air ports are used, typically in the range of 16 to 40, depending on the mill size and the type of coal being ground. The air ports are usually stationery (non-rotating) and attached to the mill housing, but can be rotary type attached to the rotatable grinding table.

The air exits from the air ports as high velocity air jet streams which are typically provided parallel to each other and have a forward angle relative to the plane of the table which is typically at 30°–45° angle, but other angles may be used. The air jets generate a swirling action for the entrained coal particles, the orientation of which is preferably in the same direction as the table rotation, for reasons of good performance of the pulverizer.

Pulverizer mill operation experience has shown that the issuing air jet action can cause undesirable acoustic resonance and vibrations inside the pulverizer mill housing. The driving excitation vibration is generated by the air jet swirling action, and is accompanied by a corresponding pressure pulsation representing a forcing function which excites the acoustic vibration. The acoustic resonance occurs when the excitation frequency generated by the air jet streams coincides with one of the acoustic (natural) frequencies of the air or air/coal mixture inside the mill. Coincidence of the air jet excitation frequency with the fundamental acoustic or natural frequency (1st mode) typically generates the most severe resonance, leading to large acoustic pressures inside the mill housing and resulting in severe structural vibrations of the mill. Coincidence of air jet excitation with higher natural frequency modes (2nd, 3rd, etc.) results typically in lower acoustic pressures inside the mill. Such vibration interferes with the normal operation of the pulverizer mill and also may produce structural damage, and cannot be tolerated.

The required air jet velocity in a pulverizer mill has lower limits, because a minimum air velocity is needed to entrain the coal upwardly from the rotary table and prevent it from falling back down through the air port openings into the air plenum. This minimum air jet velocity is a function of the coal particle size and weight. For a coal particle size of about 1.5 inch, and air temperature of about 450° F., the minimum required jet velocity is approximately 150 ft/sec which velocity prevents the coal particles from falling back down through the air ports. For the reasons explained above, lowering the air jet velocities in order to avoid acoustic resonance vibrations becomes impractical. To avoid acoustic resonance conditions, increasing the air jet velocity in conjunction with a reduction in the jet streams intersection angle remains the only viable option. However, there are two problems with increasing the air jet velocity to avoid resonance within the entire operating range of the mill. The air jet velocities must be quite high (in the 300–400 ft/sec range) for avoiding acoustic resonance within the entire range of air velocities and coal particle flows, and such high velocities may detrimentally affect mill performance and increase mill erosion. Also, such high air jet velocities would generate undesirable pressure drop across a pulverizer mill, thereby reducing mill and fan efficiency.

Even if acoustic frequency separation is achieved by changing the pulverizer mill coal flow load and thereby changing air flow for optimum mill performance, the frequency separation may be reduced to the point that the pulverizer mill would become sensitive to acoustic resonance. If the frequency separation becomes insufficient, the mill may commence vibrating. Once a mill starts vibrating, it will continue to vibrate through a large range of air flow velocities due to the well-known lock-in phenomenon. Only a significant change in air flow and/or coal flow will interrupt the pulverizer mill vibratory condition. Thus, it can be seen that the solution to the acoustic resonance vibrations by way of separation of acoustic frequencies is not a desirable or viable solution in most cases, so that other remedies have been sought.

SUMMARY OF INVENTION

This invention provides a solids pulverizer mill assembly and process for crushing coarse solids such as coal, and utilizes an air port ring with nozzle configurations which suppress acoustic vibratory excitation generated by the combined air jet and solids flow streams, so as to substantially prevent acoustic vibrations over the entire air flow and particle flow range for the mill. The pulverizer mill assembly includes a housing which encloses a rotatable table and pulverizing rollers, which are circumferentially surrounded by an air port ring containing multiple angled nozzles for air supply. The air port ring and the issuing air jet stream angles or directions are selected such that intersection and intense interaction occurs between adjacent high velocity air jet streams, even to the extreme condition of direct collision of the air jet streams. Collision and interaction of at least a pair of adjacent 3et streams, or collision and interaction of most or all of the jet streams can be achieved by special designs of the air port nozzles according to the invention.

The nozzles each have a cross-sectional area of 10–50 $in^2$ and the air flow passages can be circular, oval or rectangular in cross-sectional shape. The air jet streams are discharged from the angled nozzles at 140–250 ft/sec, and adjacent streams intersect and interact at a distance above the nozzle exit at least equal to a lateral dimension of the nozzles. The intersecting air jet streams can have an included angle of 20°–90°, and the nearer the air stream intersection point is above the air port ring upper surface, the more intense will be the air jet stream interaction. The collision and interaction of the air jet streams produces a partial or full break-up of at least some or all of the air jet streams. As a result of this air stream intersection and interaction, the following beneficial effects occur for a solids pulverizing mill such as for pulverizing coal for combustion, (a) The total energy of the swirling air/solids flow is reduced, so that less energy is available to drive any acoustic vibrations of the air/solids streams which may occur.

(b) The collision and interaction of the air jets is accompanied by a significant amount of turbulence, which has a frequency-independent turbulence spectrum generated by the jet stream interaction. The single frequency peaks or the single frequency pressure amplitudes generated by the jet swirling action which originally were driving the acoustic resonance are surrounded by or submerged in the air turbulent spectrum. This superimposed turbulence thus either reduces substantially or eliminates entirely the effectiveness of the single frequency peaks, thereby suppressing or damping the excitation.

(c) The interaction points or areas of air jet stream interactions are selected in relatively close vicinity to the air jet exits from the air port nozzles and sufficiently away from the mill internals and mill housing to minimize erosion of mill parts from the air jets and entrained abrasive solids particles.

(d) The intense interaction between the air jet streams does not affect the minimum air velocity required at the air port openings. As explained above, a minimum air velocity is required within the air port nozzle openings for preventing the larger coal particles from undesirably falling back down through the inlet air ports.

The present invention advantageously provides a solids pulverizing mill assembly and process which utilizes an air port nozzle ring which provides multiple intersecting and interacting air jet streams for entraining upwardly the pulverized solids. The air supply nozzles can provide full adjustability for the orientation angles of the air jets in order to achieve optimum pulverizer mill performance and optimum suppression of acoustic excitation within the pulverizer mill for crushable particulate solids such as coal, so that acoustic vibrations within the mill are at least minimized or are substantially eliminated.

This invention also includes a process for pulverizing coarse particulate solids material such as coal having initial size of 0.25–2.0 inch in a pulverizer mill to produce fine sized solids having particle size smaller than 100 microns and usually smaller than 10 micron, without causing undesired acoustic resonance vibrations in the mill.

BRIEF DESCRIPTION OF DRAWINGS

This invention will be described further with reference to the following drawings, in which:

FIGS. 6A and 6B show partial plan and sectional elevation views of an alternative configuration of an air port ring segment similar to FIG. 5A and 5B but for which a nozzle extension is mounted above an adjacent air jet opening so as to produce adjacent intersecting air jet streams in accordance with the invention;

DESCRIPTION OF INVENTION

Figure 1:
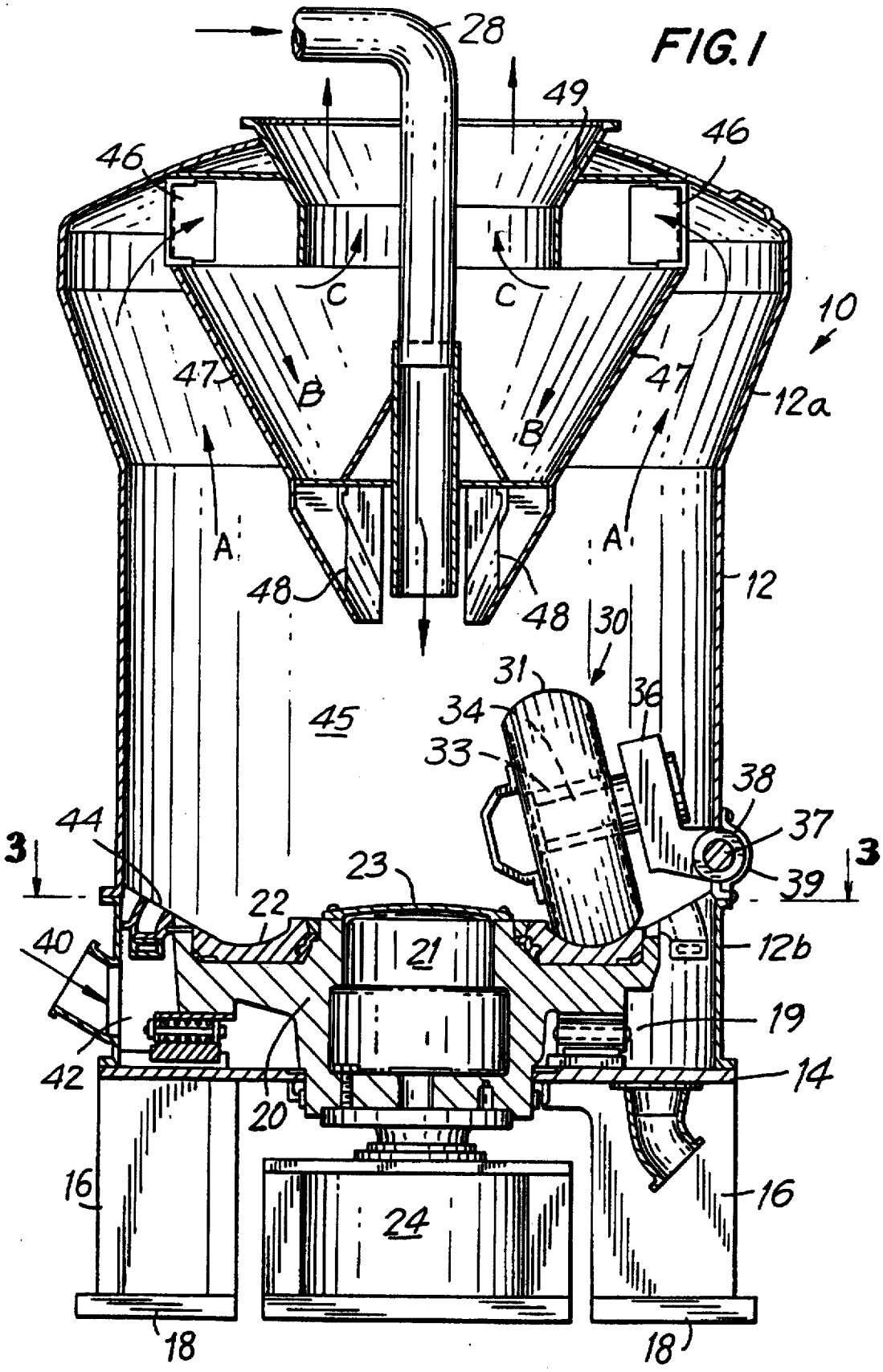
FIG. 1 is a general elevation sectional view of a solids pulverizer mill assembly having an air port ring containing multiple nozzles for providing multiple intersecting air jet streams for entraining pulverized solids according to the invention.

FIG. 1 shows a general elevation sectional view of a typical pulverizer mill assembly adapted for pulverizing coarse solids such as coal to produce fine particles having sizes between 1 and 10 microns, and having an air nozzle ring containing angled nozzles providing intersecting air jet streams according to the invention. The coal pulverizer mill generally indicated at 10 includes an outer casing or housing 12, which includes an upper portion 12*a* joined to a lower portion 12*b*. The housing lower portion 12*b* is mounted on a base plate 14, which is supported on legs 16 which extend upwardly from a suitable footing 18. Located within the lower portion of housing 12 is a circular rotatable table 20, which is supported by rollers 19 and a speed reducer and drive motor unit 24 provided directly below the table 20.

The rotatable table 20 usually has a hollow central portion 21 and includes an annular-shaped track 22 located adjacent the table periphery. The annular track 22 upper surface 22*a* is concave in cross section sectional shape and is made of wear resistant material such as hardened steel. A cover 23 bridges the hollow central portion 21 of the rotary table 20 to prevent particulate material from entering the central portion 21 above the speed reducer/drive motor 24. The annular track 22 and cover 23 are suitably attached to the rotary table 20 such as by bolts, so that the track and cover are rotated together with the table 20 by the speed reducer/drive motor unit 24.

Coarse size coal having 0.25–2 inch size range is introduced into the mill housing 12 through a central upper conduit 28, which extends downwardly through the mill upper portion 12*a* to a location above the center of the rotary table 20. The coal from conduit 28 falls onto the rotary table 20, and is moved radially outwardly by centrifugal forces to the annular concave shaped track 22. The coal passes between the track upper surface 22*a* and multiple roller units 30, which are loaded so as to press downwardly on the coal particles being ground and pulverized on the annular track 22. Although the pulverizer mill 10 employs at least two roller units 30, only one is shown in FIG. 1 for simplicity.

Each roller unit 30 includes an outer tread portion 31, which is convex curved in cross section so that it has the shape of the outer portion of a torus. The tread portion 31 is made of hardened metal and is secured to an inner wheel portion 32 positioned within the tread portion. Each roller unit 30 has a bearing 33 and rotates about an axle 34. The axle 34 includes a journal portion 35 which forms the inner race for the bearing 33, and has an increased diameter portion positioned between the journal portion 35 and an enlarged pivoted bracket 36. The roller support pivotable bracket 36 is rigidly mounted on a shaft 37, which is rotatably retained by a concentric sleeve bearing 38. The sleeve bearings 38 are enclosed by a hub 39, which is removably attached to the pulverizer housing 12. The shaft 37 is rotatably biased by external means (not shown) so that each roller unit 30 is pressed downwardly against the solids being pulverized on the annular track 22.

During operation of the pulverizing mill 10, raw coal drops down through the central conduit 28 onto the table cover 23, and moves radially outwardly due to centrifugal forces exerted by the rotating table 20 to annular track 22. The coal passes into the annular track 22 and is pulverized by the loaded rollers 30, which each rotate over the coal within the track. The shape of the tread portion 31 of each roller unit 30 and the concave shape of the track 22 tends to temporarily confine coal between the roller tread 31 and the track, so that the coal particles are exposed to pressure sufficient to crush and pulverize the coal.

The pulverized coal is entrained upwardly by a pulverizing air supply which is introduced through conduit 40 into annular air plenum chamber 42 provided beneath the rotary table 20, and then passes up through an annular air port ring 43 containing multiple angled air nozzles 44 located adjacent the table angular track 22 into the central space 45 within the housing 12. The air pressure needed in plenum 42 will depend upon the number of nozzles and air jet velocities required for effective upward entrainment of the pulverized particles, and will usually be 10–100 in. water pressure. The air velocity needed at the nozzle flow passages exit is usually 140–250 ft/sec, and preferably is 150–200 ft/sec. The flowing air carries the pulverized coal from rotary table 20 upwardly in the direction of arrows "A" to pass through a series of horizontal classifier vanes 46 which impart rotation to the mixture of air and coal particles around the vertical axis of the coal pulverizing mill 10. This arrangement acts as a centrifugal separator, so that the coarser and heavier particles are thrown outwardly and drop back down into an inner casing 47 in the direction of the arrows "B". These coarse particles drop through multiple hinged doors 48 which move inwardly under the weight of the coarse particles. The hinged doors 48 act to prevent the entrained pulverized coal moving upward in the direction of the arrows "A" from passing directly into the casing 47. The remaining fine coal particles are carried radially inwardly as shown by arrows "C" and pass upwardly through central passage 49, which conveys the air-coal mixture to its further use, such as in a coal fired steam generator (not shown).

Figure 3:
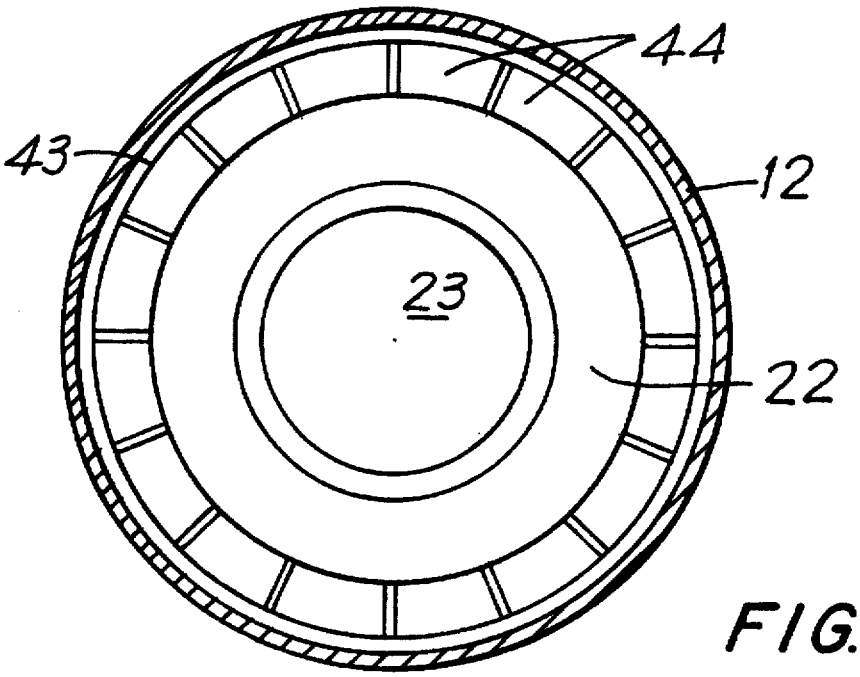
FIG. 3 is a plan sectional view taken at section line 3—3 of FIG. 1, and including an air port ring containing multiple air flow nozzles each having fixed orientation angles.

The multiple air inlet nozzles 44 are arranged in the annular ring 43 around the rotatable table 20, as generally shown in FIG. 3. The nozzles are directed upwardly at angles of 20°–90° with the horizontal plane, and are oriented radially inwardly at an angle of 10°–20° relative to the vertical plane. At least two adjacent nozzles 44 in the annular ring 43 are oriented so that their central axis intersect at an included angle of at least 20° and not exceeding 90° angle. Included angles of 25°14 80° for the intersecting nozzle axis and air jet streams are usually preferred for best acoustic vibration control results in the pulverizer mill assembly. The nozzle passageways 44 each have a cross-sectional area of 10–50 $in^2$.

Figure 2:
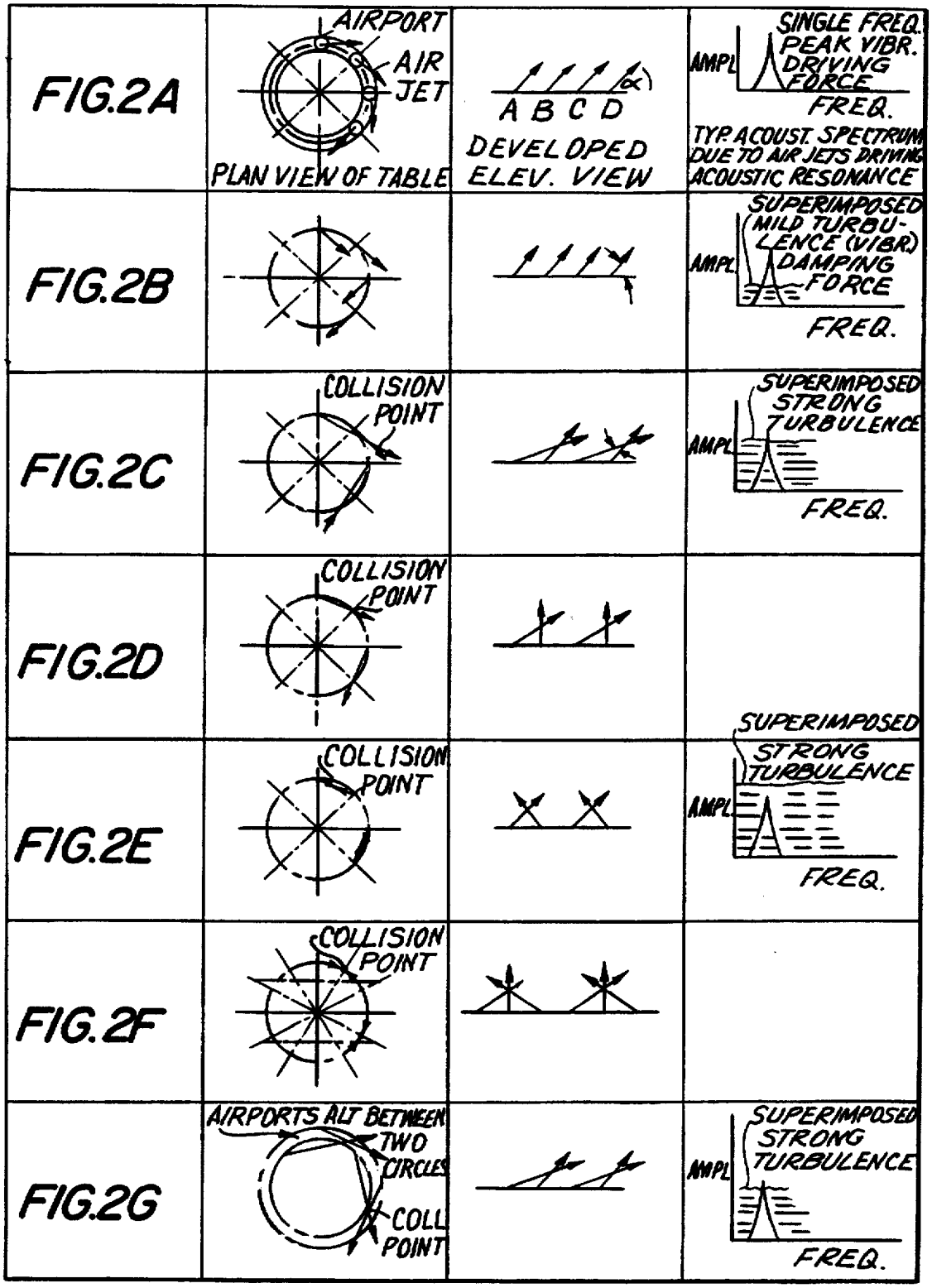
FIGS. 2A to 2G show schematically various configurations of an air port ring angled nozzles for a pulverizer mill, including the present parallel air flow pattern and also various other intersecting turbulent air stream flow patterns according to the invention.

Several examples of useful air port nozzle angles and air jet stream configurations for a pulverizer mill assembly according to this invention are shown schematically in FIGS. 2A–2G. FIG. 2A shows a typical known present arrangement of air port nozzles and jet streams oriented tangentially relative to an annular-shaped air port ring and are non-intersecting relative to each other, i.e. each air jet stream having the same non-intersecting angle $\alpha$ relative to the plane of the port ring and grinding table. Only a small number of air port nozzles and jets is shown, and the orientation direction of the air jet streams is typically the same as that of the table rotation. The arrangement of non-interacting air jets shown in FIG. 2A is known to generate predominantly a single frequency excitation spectrum which provides the driving force for undesired acoustic resonance and vibrations in a pulverizer mill.

FIG. 2B represents schematically an air port ring nozzle arrangement according to this invention providing at least two mildly intersecting and interacting air jet streams. For this configuration, in addition to the substantially single frequency peak driving force, a mild vibration damping force is superimposed due to the mild air turbulence generated by the jet streams mild interactions. This superimposed turbulence dampens and reduces the overall excitation and vibration producing potential of the air jets in a pulverizer mill.

FIG. 2C represents schematically an air port nozzle arrangement providing strongly colliding or interacting air jet streams. Multiple sets of two adjacent jets at different inclination angles $\alpha$ are directed upwardly so as to have an included angle B so as to collide and interact at a collision point located above and in close proximity to air ports exits, but sufficiently away from the grinding components and mill housing to minimize erosion of those parts. For this configuration, a strong turbulence pattern is superimposed upon the single frequency peak excitation, thereby significantly reducing or effectively eliminating the acoustic vibratory excitation in the mill.

FIGS. 2D, 2E and 2F represent schematically various other strongly interacting or colliding air jet streams for annular-shaped air port rings, including multiple sets of two strong colliding air jets in cases D and E, and sets of three colliding air jets in case F. Such nozzle and air stream configurations are applicable in cases where strong background turbulence is needed for suppression of vibratory excitations as required in a pulverizing mill.

FIG. 2G represents schematically an alternative configuration for air port rings providing strong intersecting and interacting colliding air jets for a pulverizer mill, with air port nozzles alternating between two adjacent circular paths to produce jet stream collision points above the nozzle ring. Also for this configuration, strong background turbulence dampening forces are superimposed on the single frequency peak excitations.

It will be noted that desired pulverizer mill performance considerations dictate the number, shape, and spacing of the air port nozzles, as well as the directions of the individual intersecting air jets for a particular pulverizer mill installation. The air jet interaction configurations employed for the suppression of the development of acoustic waves are selected so as to comply with the performance requirements of the mill.

FIG. 3 shows a sectional view of the coal pulverizer 10 taken at line 3—3 of FIG. 1, and including the outer housing 12 which supports annular-shaped air port ring 43 containing multiple fixed angle air flow nozzles 44. For convenience, the roller units 30 are not shown located above annular track 22 of rotary table 20. The number of air port nozzles having fixed angles of orientation so as to produce intersecting air streams is at least 16, and usually need not exceed about 40. The air port ring 43 can be fixedly attached onto the inner wall of housing **12*b*, or can be fixedly attached onto the periphery of the rotary track 22 so as to rotate together with the table 20**.

Figure 4A:
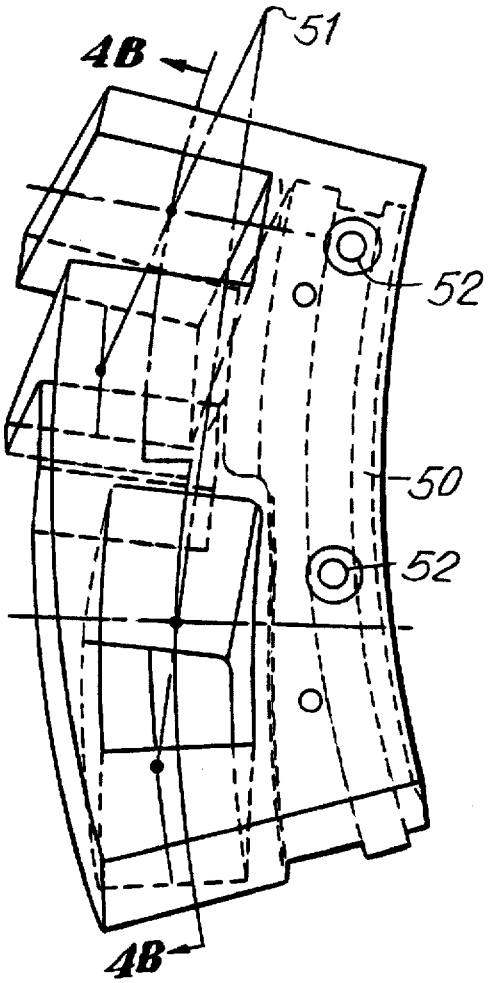
FIGS. 4A and 4B show partial plan and sectional views of air port ring segments having flow nozzles each oriented at fixed intersecting angles, which ring segments can replace existing air port rings in a pulverizer mill.
Figure 4B:
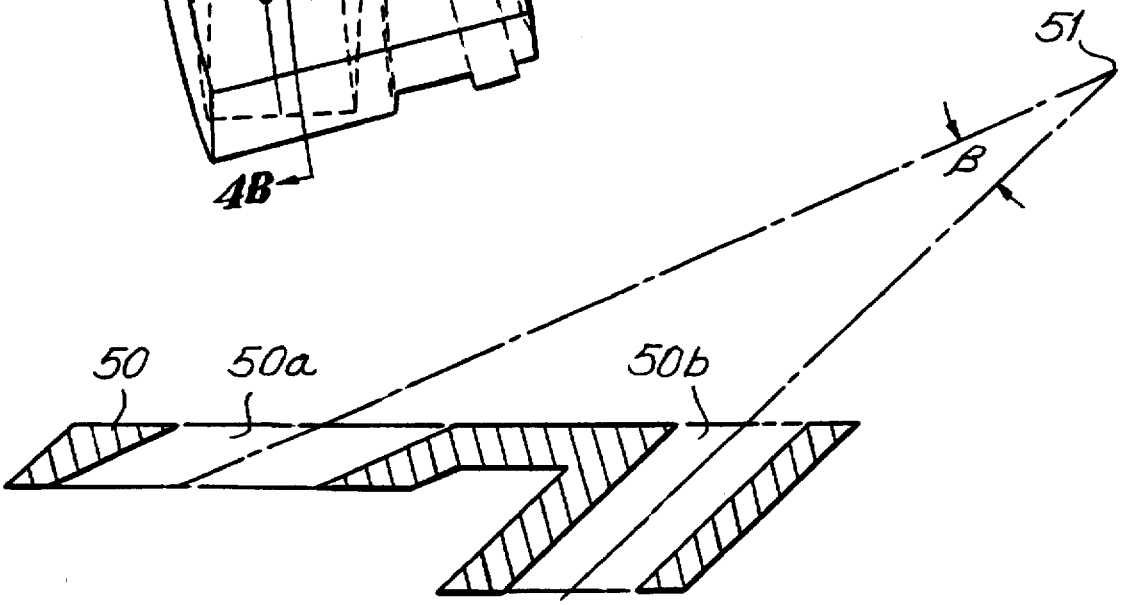

The air port ring 43 for a pulverizer mill 10 can be advantageously provided as multiple segments fixedly attached to the mill rotary table 20 by bolts. FIGS. 4A and 4B show an air port ring segment having adjacent nozzles oriented at included intersecting angles B of 20°–90°. These ring segments can be used either in new pulverizer mills or can replace the air port rings in existing pulverizer mills. FIG. 4A and 4B show plan and sectional views, respectively, of an air port ring segment 50, in which adjacent flow nozzle passages 5O*a* and **50*b* each have a centerline which intersects to form an included angle B of 20°–90° at a stream collision point 51 usually located about 3–12 inches above the upper surface of the particular ring segment. The ring segment 50 has through holes 52 by which it is removably attached to the mill rotary table 20** by multiple bolts (not shown).

Figure 5A:
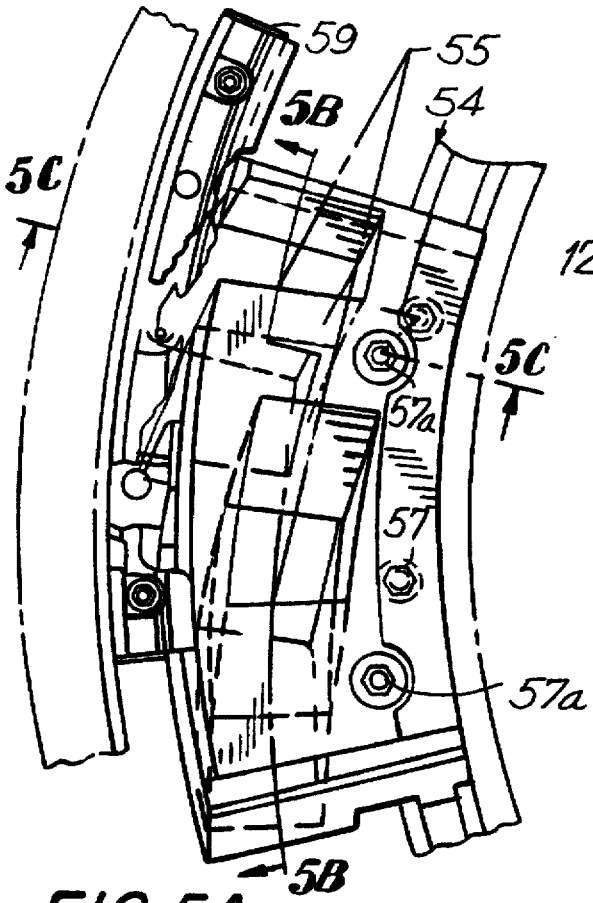
FIGS. 5A and 5B show plan and sectional views of air port ring segments similar to FIG. 4A and 4B but having upper and lower mating parts.
Figure 5C:
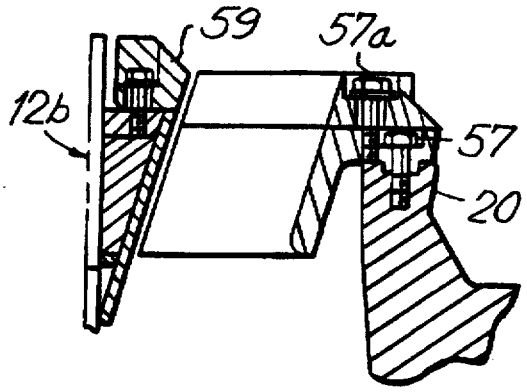
FIG. 5C is a cross-sectional elevational view of FIG. 5A taken at section line 5C—5C showing attachment of an air port ring segment onto the rotary table.
Figure 5B:
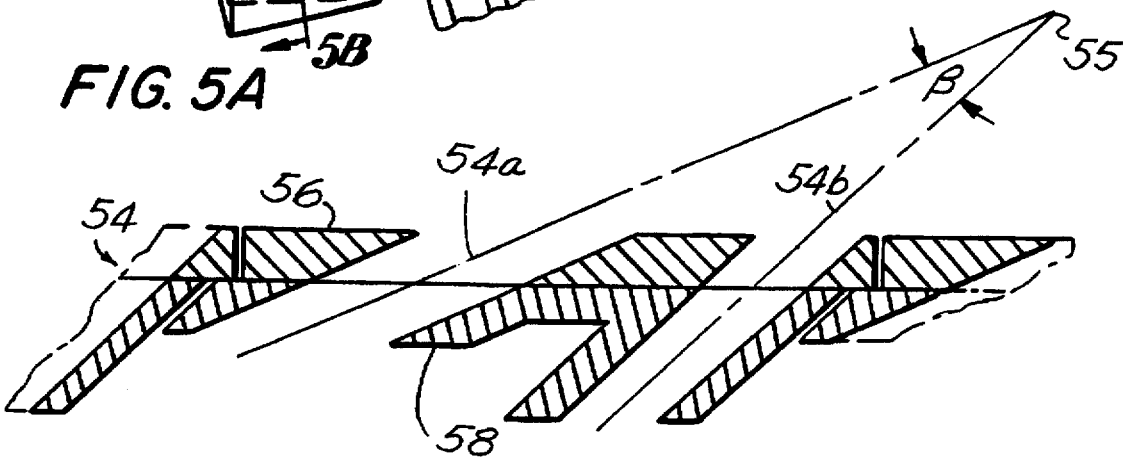

FIG. 5A and 5B show plan and sectional views respectively of an alternative air port ring segment 54, which is similar to FIG. 4A and 4B but includes an upper plate portion 56 which is fixedly mounted onto a lower plate portion 58 so as to provide adjacent common nozzle flow passageways **54*a* and 54*b*. These passageways for both the upper and lower portions have centerlines which intersect at included angle B at a point 55 located above the upper surface of the ring segment 56. The lower ring segment 58 is fixedly attached to the mill rotary table 20 by multiple bolts 57, and the upper ring segment 56 is fixedly attached to the lower ring segment 58 by bolts 57*a*. FIG. 5C shows details of the attachment of ring segment 54 upper and lower portions onto rotary table 20, and also shows an outer spacer ring unit 59 fixedly attached to the inner surface of housing lower portion 12*b* so as to provide a small radial gap between the ring segment 54 and the spacer unit 59. It will be noted that for this air port ring segment configuration, either or both the upper or lower portions of each segment 54** of the air port ring can be advantageously replaced as needed to correct or adjust the air stream angles of intersection, or for reasons of excessive erosion of the parts due to the passage of abrasive particles through the nozzles over an extended period of time.

FIG. 6A and 6B show a partial plan and sectional views of an alternative configuration of an annular air port ring segment 60, which includes upper plate portion 62 fixedly mounted onto lower plate portion 64 by means of multiple bolts (not shown) similarly as for FIGS. 5A–5C. The upper plate portion 62 and lower plate portion 64 each contain flow passageways **62*a* and 64*a*, respectively. A nozzle extension piece 65 is fixedly mounted above selected opening in the upper plate 62 containing opening 62*a*, so as to produce adjacent air jet streams which intersect at a collision point 66 above the upper surface of ring segment 62 at included angle γ. The extension piece 65 is attached to the upper ring segment 62 by multiple threaded screws 63. If desired, such nozzle extension pieces 65 can be mounted above some but not all of the air flow passageways 50*a*** in the air port ring integral segments as shown by FIGS. 4A–4B.

Figure 7:
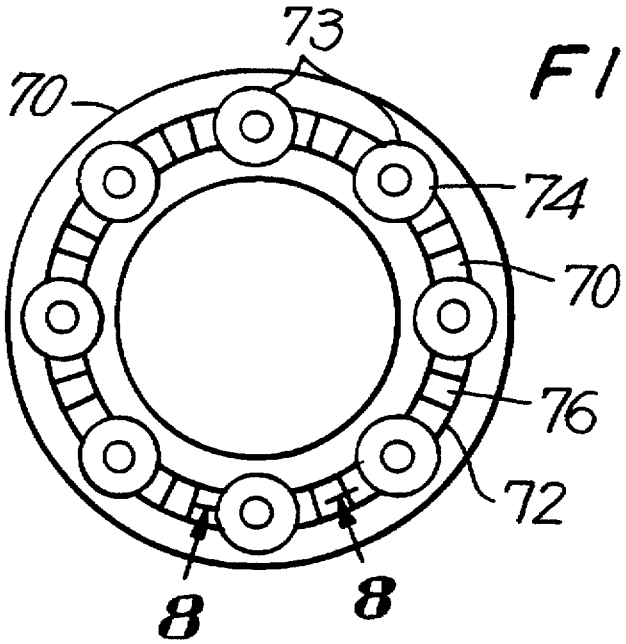
FIG. 7 is a schematic plan view of an air port ring containing multiple fixed angle nozzles alternated with variable angle type flow nozzles in the ring.
Figure 8:
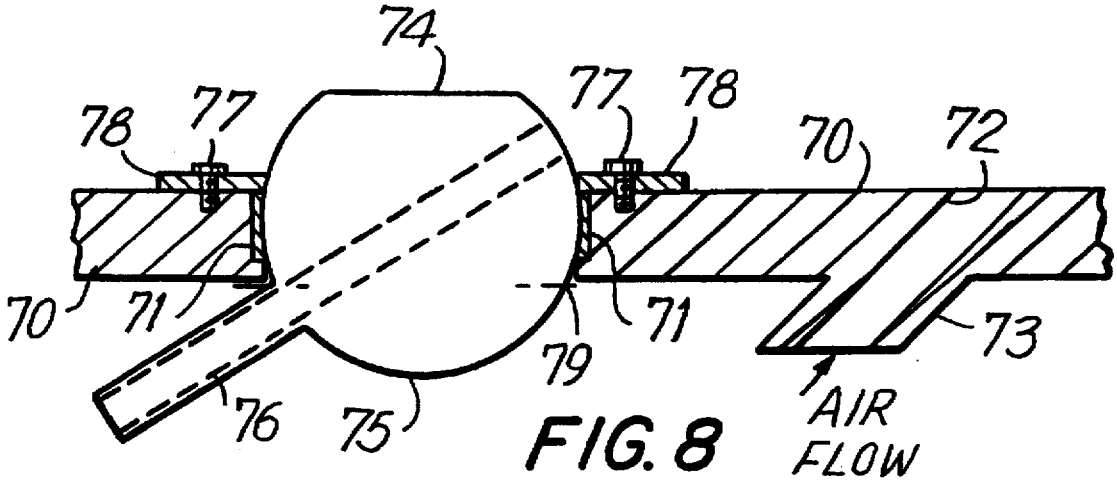
FIG. 8 is a sectional view of an air port ring taken at line 8—8 of FIG. 7 showing both variable angle and fixed angle type nozzles.

FIG. 7 shows a schematic plan view of an alternative annular-shaped air port ring 70 which contains multiple fixed angle nozzles 72 which are used in combination with multiple adjustable angle type nozzles 74, so as to provide multiple intersecting high velocity air jet streams. A sectional view of this air port nozzle ring 70 is further shown in FIG. 8. The adjustable angle air jet nozzles 74 include a ball or spherical shape central element 75, which is pivotable within a mating socket 71 of the ring 70, and includes a nozzle extension piece 76 for increasing the directivity of the air jet streams. The ball shaped element 75 is retained in socket 71 by an annular-shaped holddown clamp 78 which is attached to the ring 70 by multiple threaded screws 77. Angular positioning of the ball element 75 in recess 71 so that the passage centerlines of the adjacent fixed nozzles 72 and adjustable nozzle 74 intersect at a desired point above ring 70 is provided by retaining pins 79 inserted into the outer surface of the ball 75. The pins 79 permit orientation of nozzle 74 so that adjacent air jet streams intersect either mildly or strongly to at least produce sufficient turbulence so as to minimize or usually eliminate undesired acoustic vibrations in the pulverizer mill. The ball elements 75 usually have diameter of 5–10 inches and nozzle cross-sectional area of 10–50 in.$^2$, and preferably have 15–40 in.$^2$ cross-sectional area. The nozzle flow passages through the ball elements 75 can be circular, oval or rectangular in cross-sectional shape, with a circular shape usually being preferred. These adjustable nozzles 74 are preferably used in combination with the fixed angle nozzles 72 in the annular ring unit 70.

Figure 9:
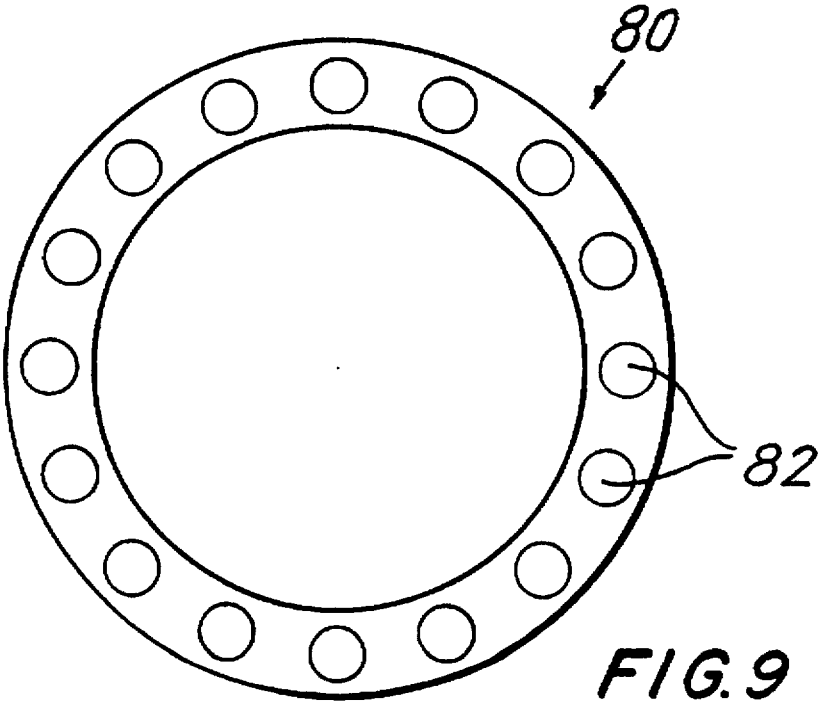
FIG. 9 is a schematic plan view of an air port ring in which all the nozzles have adjustable angles.

FIG. 9 generally shows an air port ring 80 in which all the nozzles 82 are adjustable angle type in which adjacent nozzles have flow passages which intersect at a point 3–12 inches above the ring upper surface and at an included angle of 20°–90°, so as to at least minimize or usually eliminate acoustic vibrations in a solids pulverizer mill.

Although this invention has been described broadly and in terms of preferred embodiments, it will be understood that modifications and variations can be made all within the scope of the invention as defined by the following claims.

I claim:

1. A solids pulverizer mill assembly for pulverizing coarse particulate materials, the mill including a housing, a grinding table rotatably mounted in the housing and having multiple air port nozzle openings provided in an annular ring mounted between the grinding table periphery and the housing wall, and roller means contacting the grinding table upper surface for pulverizing the particulate material thereon, wherein the improvement comprises providing the annular air port ring containing multiple nozzles each being directed upwardly at an angle of 20°–90° with the horizontal plane with at least two adjacent air jet nozzle flow passageways each having a central axis which is oriented relative to said ring and rotary table so as to intersect at a point above the ring and provide an included angle within a range of 20°–90°, whereby the air jet streams from said adjacent nozzles intersect and acoustic vibrations induced within the mill during operations are substantially eliminated by intense interaction of the intersecting air flow streams within the mill housing.

2. A pulverizer mill assembly according to claim 1, wherein the nozzle flow passageways are oriented forwardly at an angle of 20°–60° relative to a horizontal plane and have an included angle between the centerline of adjacent nozzles of 25°–80–°.

3. A pulverizer mill assembly according to claim 1, wherein the air port nozzle ring flow passageways are oriented radially inwardly at an angle of 10°–20° relative to a vertical plane.

4. A pulverizer mill assembly according to claim 1, wherein each said nozzle passageway has cross-sectional area of 10–50 $in^2$.

5. A pulverizer mill assembly according to claim 1, uherein said air port ring contains between 18 and 36 nozzle flow passageways.

6. A pulverizer mill assembly according to claim 1, wherein said annular-shaped air port ring has nozzles provided on two concentric circles each having different diameters.

7. The pulverizer mill assembly of claim 1, wherein said annular air port ring comprises multiple segments each removably attached to the housing wall at a location circumferentially surrounding the grinding table, said ring segments each including an upper part which is removably attached to a lower part of the ring segment.

8. A pulverizer mill assembly according to claim 1, wherein said air port ring contains multiple nozzle units which are each pivotably mounted within the ring, each said nozzle unit being pivotable within an angle of 20°–90° with the plane of the ring.

9. A pulverizer mill assembly according to claim 8, wherein said pivotably adjustable angle nozzles are alternated with fixed angle nozzles in the air port ring.

10. A pulverizer mill assembly according to claim 8, wherein said pivotable nozzle units each include a spherical-shaped element embedded in the air port ring, said element having diameter of 5–10 inch.

11. A solids pulverizer mill assembly for pulverizing coarse particulate materials, the mill including a housing, a rotary grinding table mounted on a speed reducer and motor in the housing and having multiple air port openings provided in an annular air port ring mounted between the grinding table periphery and the housing wall, and multiple roller means contacting the grinding table upper surface for pulverizing the particulate material thereon, wherein the improvement comprises providing the annular-shaped air port ring with 16–36 nozzle passages each having cross-sectional area of 10–50 $in^2$ and in which multiple pairs of the air flow nozzles have central axis which are oriented upwardly relative to the ring and rotary table plane at an angle of 20°–90° and to intersect at a point above the ring and have an included angle of 20°–90°, whereby the air jet streams from said adjacent nozzles intersect so that acoustic vibrations induced within the mill during operations are substantially eliminated by the intense interactions of the intersecting air flow streams within the mill housing.

12. A process for pulverizing coarse particulate solid material in a pulverizer mill to produce fine sized solids, comprising the steps of:

(a) feeding a coarse solids material having a particle size of 0.25–2 inch downwardly onto a rotating table having a concave annular-shaped upper surface;

(b) passing compressed air upwardly through an annular ring having a plurality of nozzle passageways located concentrically around the rotating table, said passageways each having a central axis which is oriented upwardly at angle of 20°–90° relative to the table plane, so that the air stream exiting from adjacent nozzle passageways intersects and interacts strongly with an adjacent air stream at a point above the nozzle ring at an included angle of 20°–90°, so as to create flow turbulence sufficient to avoid acoustic resonance vibrations within the pulverizer mill; and (c) withdrawing air and entrained fine sized pulverized solids material from the upper portion of the pulverizer mill.

13. The solids pulverizing process of claim 12, wherein the coarse sized solids material is coal having 0.5 inch particle size, and the coal is pulverized to 1–10 micron particle size.

14. The solids pulverizing process of claim 12, wherein the compressed air pressure is 10–100 in. of water pressure, and the nozzle air exit velocity is 140–250 ft/sec.

15. The solids pulverizing process of claim 12, including adjusting the nozzle included angle within a range of 30°–80° during operation.

16. The solids pulverizing process of claim 12, wherein the entrained air/coal weight ratio is in a range of 1.5/1 to 3.5/1.

17. A process for pulverizing coarse particulate coal in a pulverizer mill to produce fine sized coal particles, comprising the steps of:

(a) feeding a coarse coal having particle size of 0.25–2 inch downwardly onto a rotating table having a concave annular-shaped upper surface;

(b) passing compressed air at 10–100 in. water pressure upwardly through an air port ring containing a plurality of nozzle passageways located concentrically around the rotating table, each said nozzle passageway having a central axis which is oriented upwardly at angle of 20°–90° relative to the table plane, each air stream exiting each said nozzle passageway at 140–250 ft./sec velocity so that it intersects and interacts strongly with another air stream at a point above the nozzle ring and at an included angle of 20°–90°, so as to create air flow turbulence sufficient to avoid acoustic resonance vibrations within the pulverizer mill; and (c) withdrawing air and an entrained fine sized pulverized coal powder material from the upper portion of the pulverizer mill.

* * * * *